US005431586A

United States Patent [19]

Klas et al.

[11] Patent Number: 5,431,586

[45] Date of Patent: Jul. 11, 1995

[54] ELECTRICAL CONNECTOR WITH MODULAR NOSE

[75] Inventors: Daniel E. Klas, Black Mountain; Regina L. Tipton, Nebo, both of N.C.

[73] Assignee: Hubbell Incorporated, Orange, Conn.

[21] Appl. No.: 170,938

[22] Filed: Dec. 21, 1993

[51] Int. Cl.[6] ..... H01R 9/24

[52] U.S. Cl. ..... 439/676; 439/717

[58] Field of Search ..... 439/676, 717

[56] References Cited

U.S. PATENT DOCUMENTS

| | | | |
|---|---|---|---|
| 2,943,272 | 6/1960 | Feldman | 333/12 |
| 3,496,555 | 2/1970 | Jones | 340/174 |
| 3,757,028 | 9/1973 | Schessel | 174/33 |
| 3,891,815 | 6/1975 | Hiele | 335/152 |
| 4,221,458 | 9/1980 | Hughes et al. | 339/126 R |
| 4,290,664 | 9/1981 | Davis et al. | 439/676 X |
| 4,367,908 | 1/1983 | Johnston | 439/676 |
| 4,413,469 | 11/1983 | Paquin | 57/273 |
| 4,481,379 | 11/1984 | Bolick | 174/117 |
| 4,556,264 | 12/1985 | Tanaka | 339/17 LC |
| 4,689,441 | 8/1987 | Dick | 174/68.5 |
| 4,767,355 | 8/1988 | Phillipson et al. | 439/425 |
| 4,831,497 | 5/1989 | Webster | 361/406 |
| 4,850,887 | 7/1989 | Sugawara | 439/108 |
| 4,863,393 | 9/1989 | Ward et al. | 439/188 |
| 4,946,401 | 8/1990 | Hori et al. | 439/676 X |
| 5,037,320 | 8/1991 | Stolte | 439/188 |
| 5,039,824 | 8/1991 | Takashima | 174/33 |
| 5,061,209 | 10/1991 | Bolick, Jr. et al. | 439/676 |
| 5,064,387 | 11/1991 | Lybrand | 439/676 X |
| 5,096,441 | 3/1992 | Jaag | 439/676 |
| 5,145,401 | 9/1992 | Archer | 439/395 |
| 5,186,647 | 2/1993 | Denkmann | 437/395 |
| 5,226,835 | 7/1993 | Baker, III et al. | 439/403 |
| 5,269,708 | 12/1993 | De Young | 439/676 |

*Primary Examiner*—Eugene F. Desmond

*Attorney, Agent, or Firm*—Jerry M. Presson; Mark S. Bicks

[57] ABSTRACT

An electrical connector has a modular nose or modular noses. The modular nose can be interlocked with the housing or can be interlocked with other noses and the housing or only with other noses. The interlocking is provided by projections extending laterally from opposite sides of the nose. These projections engage correspondingly shaped notches in adjacent noses or in adjacent portions of housings.

21 Claims, 3 Drawing Sheets

ELECTRICAL CONNECTOR WITH MODULAR NOSE

REFERENCE TO RELATED APPLICATION

This application is related to U.S. patent application Ser. No. 08/110,829 of Gentry et al., filed Aug. 24, 1993 and entitled Modular Jack with Enhanced Crosstalk Performance, the subject matter of which is hereby incorporated by reference.

FIELD OF THE INVENTION

The present invention relates to an electrical connector with a modular nose. More particularly, the modular nose has mating, laterally extending projections for engaging and ganging together a plurality of similar noses or for engaging a housing in an interlocking manner.

BACKGROUND OF THE INVENTION

Electrical connectors or modular jacks for telecommunications and data transmission connectors are disclosed in U.S. Pat. No. 4,648,678 to Archer and U.S. Pat. No. 5,061,209 to Bolick, the subject matters of which are hereby incorporated by reference. In connectors of this type, the contact geometries are defined by standards for interchangeability with mating connectors. The connector standards have existed prior to the need for a wide variety of data communications applications. Additionally, the standards have created a large base of installed connectors.

With certain applications, both single and multiple port applications are necessary. In manufacturing the single and multiple port assemblies, the use of a single nose, which can be interlocked in a single port housing or to be ganged together and mounted in different multiple port connector assemblies, is advantageous. Using different nose constructions for different types of electrical connectors creates a significant inventory and manufacturing problems.

SUMMARY OF THE INVENTION

An object of the present invention is to provide an electrical connector with a modular nose which can be used to form single port and different multiple port assemblies.

Another object of the present invention is to provide an electrical connector nose which can be interlocked and ganged together with other similarly constructed noses or interlocked in a housing.

The foregoing objects are basically obtained by an electrical connector comprising a nose of dielectric material having first, second and fourth side walls and first and second opposite end walls. A plug receiving cavity opens through at least the first end wall. The first and second side walls are opposite each other. The second and fourth side walls are opposite each other. Contact support means is formed in the nose for mounting electrically conductive contacts within the nose. At least one laterally extending projection is integrally formed on each of the first and third side walls of the nose. A housing has a recess opening on at least one surface of the housing and receives the nose. Housing notches mate with and receive the nose projections. The housing notches open into the housing recess.

The foregoing objects are also basically obtained by an electrical connector comprising first and second noses of dielectric material. Each of the noses includes first, second, third and fourth side walls defining a plug receiving cavity, with the first and second side walls being opposite and the second and fourth side walls being opposite. The cavity opens on one of first and second opposite end walls. Contact support means are formed on the side walls for mounting electrically conductive contacts within the cavity of each nose. At least one laterally extending projection is integrally formed on each of the first and second side walls. At least one nose notch is formed on each of the first and second side walls adjacent to the projection thereon, with the projections and nose notches having complementary configurations. The projection and nose notch on each first side wall is laterally offset from the projection and nose notch, respectively, on the respective third side wall. The projection on each first side wall is aligned with the nose notch on the respective third side wall. The projection on each third side wall is aligned with the nose notch on the respective first side wall. The first and second noses are engaged with the third side wall of the first nose abutting the first side wall of the second nose and with the nose notches on the third side wall of the first nose and on the first side wall of the second nose receiving the projections on the first side wall of the second nose and on the third side wall of the first nose, respectively.

By forming the connector in this manner, a single, modular nose construction can be used for a wide variety of applications. These applications can involve the use of a single nose mounted and interlocked within a housing. The nose can also be joined with other similarly constructed noses in applications involving two or more noses which are ganged together and then inserted and interlocked with each other as well as with a supporting housing. This permits the nose to be used in a wide variety of different applications and products.

Other objects, advantages and salient features of the present invention will become apparent from the following detailed description, which, taken in conjunction with the annex drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
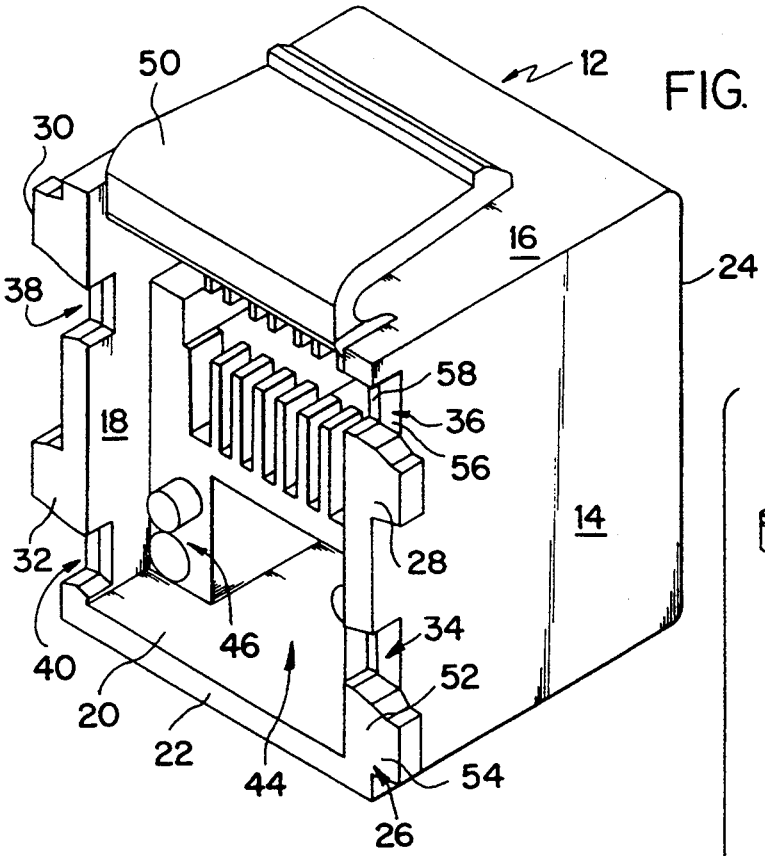
FIG. 1 is a perspective view of the modular nose for an electrical connector according to the present invention.
Figure 2:
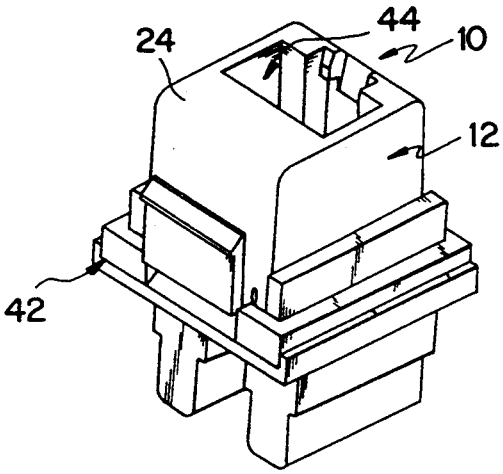
FIG. 2 is a perspective view of the modular nose of FIG. 1 mounted in a housing assembly to form an electrical connector with a single port.

The present invention, as illustrated in FIGS. 1 and 2, comprises an electrical connector 10 having at least one nose 12. Nose 12 comprises first, second, third and fourth side walls 14, 16, 18 and 20, and first and second opposite end walls 22 and 24. The first and second side walls are opposite each other, while the second and fourth side walls are opposite each other. Laterally extending projections or tabs 26, 28, 30 and 32 and laterally extending nose notches 34, 36, 38 and 40 are formed in the first and second side walls to permit the nose to be interlocked with a similarly constructed nose or noses, and/or a housing 42.

The side walls define an internal, plug receiving cavity 44 which opens on both end walls 22 and 24 of nose 12. Cavity 44 is shaped to receive an FCC approved electrical connector or plug (not shown). Within cavity 44, a contact support 46 is arranged for mounting electrically conductive contacts within the nose. The configurations of the plug receiving cavity 44 and contact support 46, as well as the conductive electrical contacts mounted therein, are disclosed in detail in co-pending U.S. patent application Ser. No. 08/110,829, identified and incorporated by reference above, and thus, are not described and illustrated in detail herein. For a description of the plug receiving cavity and of the contact support in the cavity, reference is made to that co-pending U.S. patent application.

The outer surface of side wall 20 comprises a fixed latch member for engaging another structure, for example, a support panel or housing. Opposite side wall 16 has an integrally formed, resilient tab 50 of conventional configuration.

Each projection or tab 26, 28, 30 and 32 is integrally formed on the respective side wall and has the same shape. Immediately adjacent the respective side wall, each projection extends outwardly and tapers to form a generally trapezoidal shaped portion 52 when viewed from the end wall. Trapezoidal portion 52 extends to a rectangular terminal portion 54 of each projection.

Each of the notches 34, 36, 38 and 40 are shaped in a similar manner and to correspond or mate with the projections. Specifically, each notch has a trapezoidal portion 56 tapering inwardly and an inward rectangular portion 58.

The projections and notches are generally coplanar with each other and with end wall 22. The projections and notches on each of side walls 14 and 18 are alternatively arranged and are spaced along the length of the respective side wall. Each nose notch is oriented adjacent one of the projections. The projections extending from side wall 14 are laterally offset from the projections extending from opposite side wall 18. Similarly, nose notches in side wall 14 are laterally offset from the nose notches in side wall 18. Projection 26 is aligned with nose notch 40. Nose notch 34 is aligned with projection 32. Projection 28 is aligned with nose notch 38. Nose notch 36 is aligned with projection 30. In this manner, the projections on each side wall are aligned with a notch on the opposite side wall. Such orientation facilitates ganging together a plurality of noses with the first side wall of one nose abutting the third side wall of another, adjacent nose, with projections 26 and 28 being received within notches 40 and 38, respectively, and with projections 32 and 30 being received within notches 34 and 36, respectively.

Figure 3:
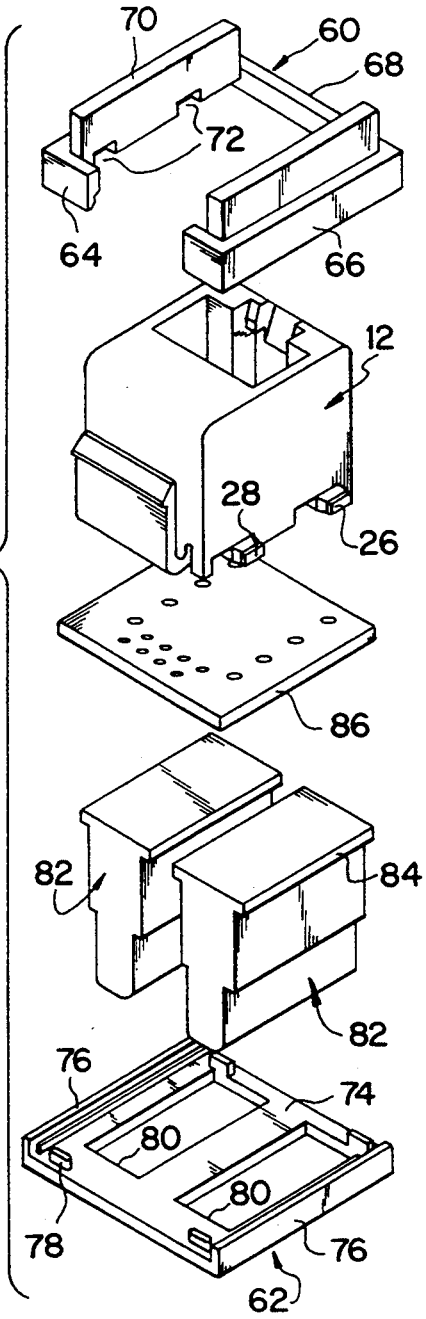
FIG. 3 is a exploded, perspective view of the electrical connector of FIG. 2.

Referring to the first embodiment of the electrical connector employing nose 12, illustrated in FIGS. 2 and 3, housing 42 of electrical connector 10 comprises a shroud top 60 and a shroud bottom 62. Shroud top 62 constitutes a frame with sides 64, 66, 68 and 70. Sides 66 and 70 have housing notches 72. These housing notches are configured and shaped to receive nose projections 26, 28, 30 and 32. Shroud bottom 62 comprises a rectangular base 74 and two upstanding walls 76. Base 74 has four upstanding tabs 78 adjacent its four corners and two rectangular openings 80.

Openings 80 receive insulating piercing contact support blocks 82. Each contact support block has an upper flange 84 which engages and abuts shroud bottom base 74 about the respective opening 80.

A printed circuit board 86 is engaged with and between nose 12 and support blocks 82. Electrically conductive contacts mounted in support blocks 82 and in nose 12 engage circuit paths on circuit board 86 to provide electrical connection between the contacts mounted in blocks 82 and the contacts mounted in nose 12.

Electrical connector 10 is assembled as illustrated in FIGS. 2 and 3. Since housing notches 72 open downwardly and are closed in an upward direction, as illustrated in FIG. 3, by portions of shroud top sides 70 and 66, nose 12 is retained within the housing by being trapped between shroud top 60 and shroud bottom 62. Portions of blocks 82 and circuit board 86 are also trapped between the shroud top and bottom. The entire structure can be secured together by ultrasonic welding.

Figure 4:
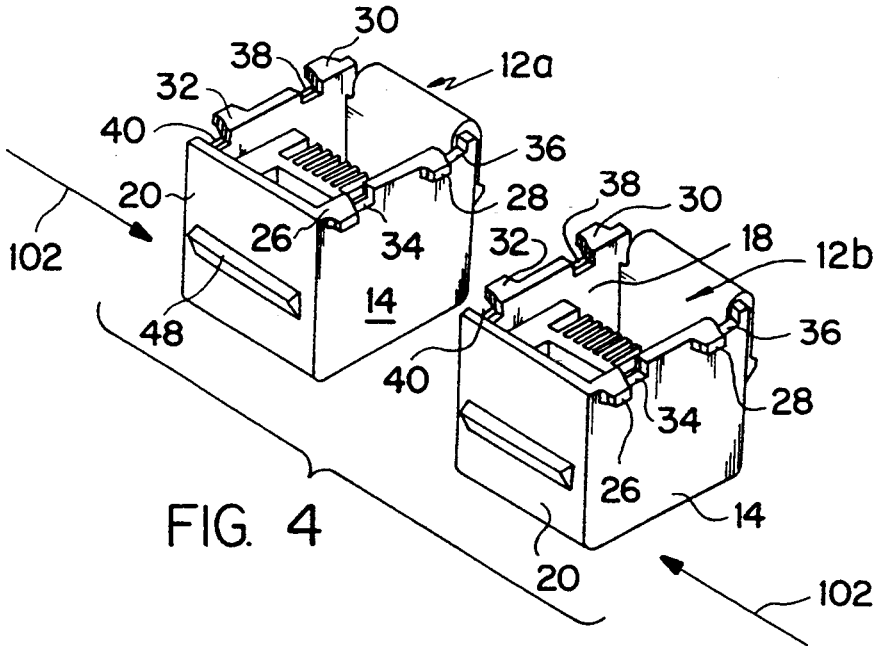
FIG. 4 is perspective view of two modular noses according to the present invention about to be ganged together according to a second embodiment of the present invention.
Figure 5:
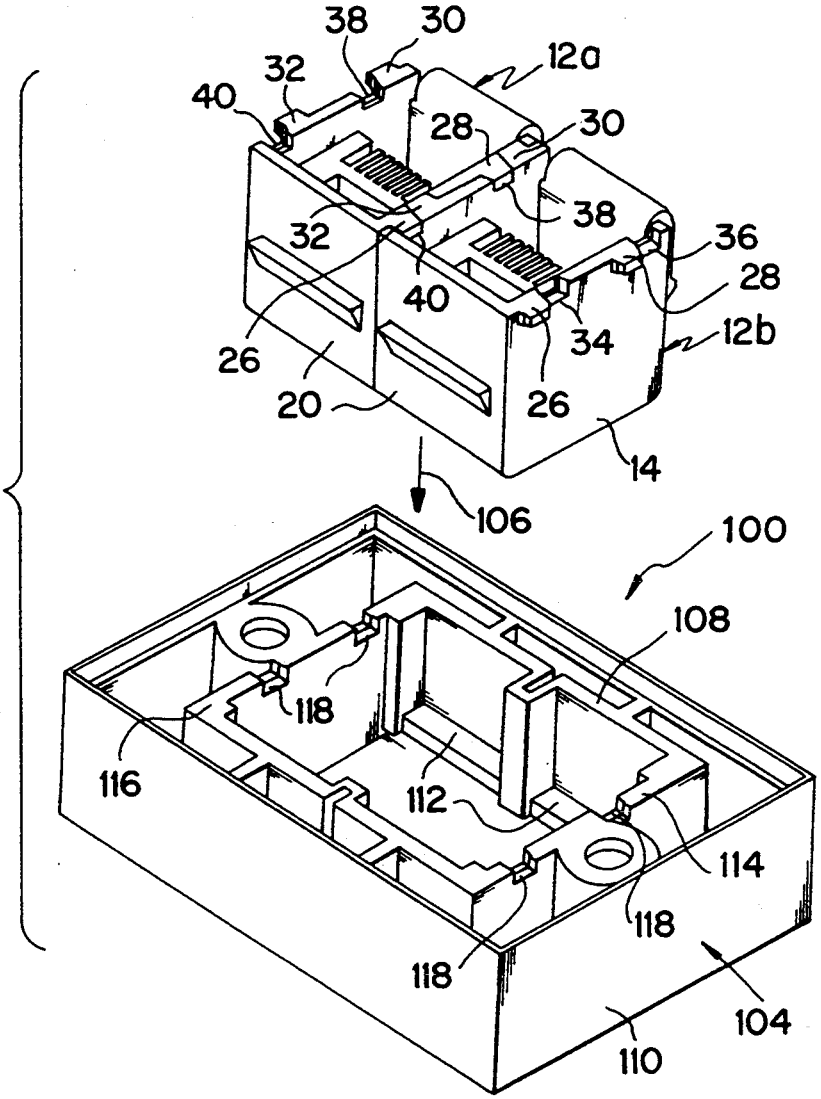
FIG. 5 is a perspective view showing the modular noses of FIG. 4 after they have been ganged together, but prior to being inserted into a housing.
Figure 6:
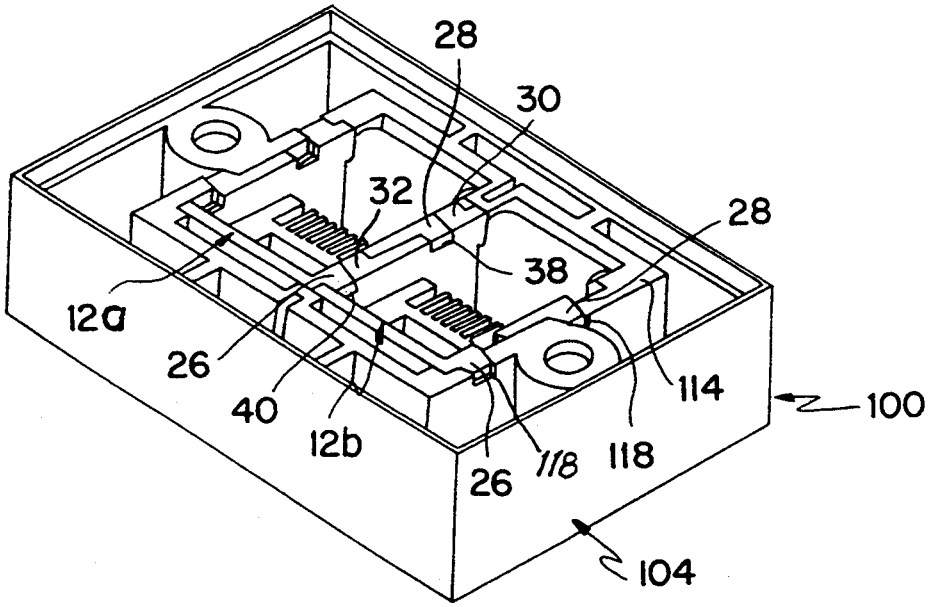
FIG. 6 is a perspective view illustrating the modular noses and housing of FIG. 3, after assembly to form an electrical connector with two ports.

An electrical assembly 100 according to a second embodiment of the present invention, using two noses 12 is illustrated in FIGS. 4–6. To facilitate description of electrical connector 100, the two noses are identified in the drawings with **12*a* and 12*b***.

Connector 110 is initially formed by ganging noses **12*a* and 12*b* by sliding them together in the directions indicated by arrows 102 in FIG. 5. Noses 12*a* and 12*b* are engaged with side wall 18 of nose 12*b* abutting side wall 14 of nose 12*a*. Projections 26 and 28 of nose 12*a* are received within notches 40 and 38, respectively, of nose 12*b*. Projections 30 and 32 of nose 12*b* are received within notches 36 and 34, respectively, of nose 12*a*. Once noses 12*a* and 12*b* have been ganged together, they are ready to be inserted within housing 104 in the direction indicated by arrow 106**.

Housing or shroud 104 can be adapted for any number of noses. In the illustrated example, the housing is adapted to receive two noses **12*a* and 12*b*** as ganged together in the manner described above. This illustrated electrical connector provides a two port adaptor assembly.

Housing 104 comprises an inner frame 108 and an outer frame 110, which are unitarily molded together. The inner surface of inner frame 110 comprises suitable catches 112 for engaging the fixed latch members 48 and the resilient tabs 50 of the noses. The opposite sides 114 and 116 contain housing notches 118. Housing notches 118 in inner frame side 114 receive projections 26 and 28 of nose **12*b*. Housing notches 118 in inner frame side 116 receive projections 30 and 32 of nose 12*a*. The engagement of the nose projections, fixed latch member and resilient tab with the corresponding features of housing 104 securely and accurately lock the noses within the housing and facilitates the assembly thereof as illustrated in FIG. 6**.

Figure 7:
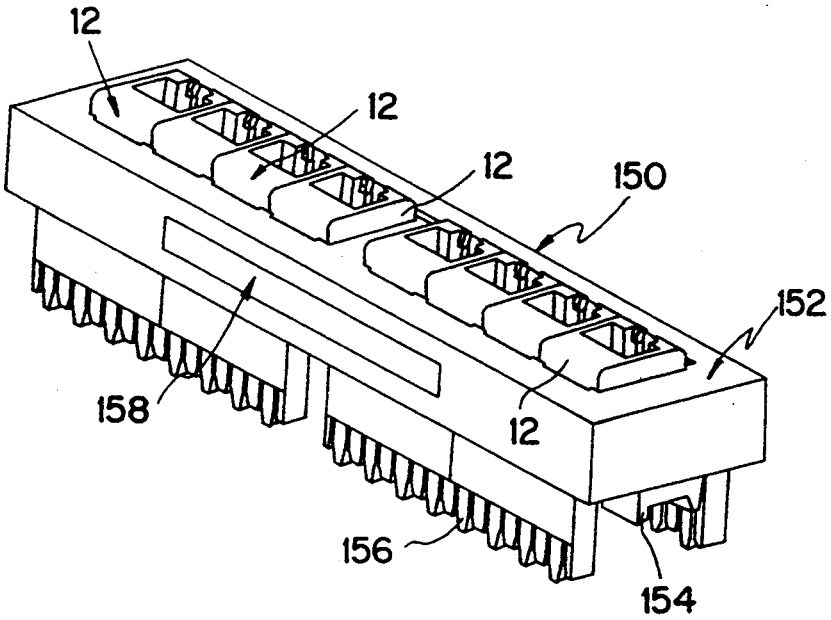
FIG. 7 is a perspective view of an electrical connector with eight ports and including a plurality of noses according to a third embodiment of the present invention.

FIG. 7 illustrates an electrical connector 150 having a housing or shroud 152 forming an eight port adapter assembly, with the noses or ports arranged in two groups of four each. Housing 52 includes wire tie mounts 154 and insulation piercing contact supports 156. A label 158 can be secured to the front face of the housing. In electrical connector 150, noses 12 are secured to each other and to the shroud 152 in the same manner as described above in connection with FIGS. 2–3 and in FIGS. 4–6.

While particular embodiments have been chosen to illustrate the invention, it will be understood by those skilled in the art that various changes and modifications can be made therein without departing from the scope of the invention as defined in the appended claims.

What is claimed is:

1. An electrical connector, comprising:

a first nose of dielectric material having first, second, third and fourth side walls and first and second opposite end walls, said side walls defining a plug receiving cavity opening through at least said first end wall, said first and third side walls being opposite, said second and fourth side walls being opposite;

contact support means, formed in said first nose, for mounting electrically conductive contacts within said first nose;

at least one laterally extending projection integrally formed on each of said first and third side walls of said first nose;

at least one nose notch on each of said first and third side walls of said first nose adjacent to said projection thereon, said projections and said nose notches on said first nose having complementary configurations;

a housing having a recess opening on at least one surface of said housing and receiving said first nose, and having housing notches mating with and receiving said projections, said housing notches opening into said recess; and a second nose of dielectric material positioned in said recess of said housing adjacent to said first nose, said second nose having first, second, third and fourth side walls, first and second opposite end walls and a plug receiving cavity opening through at least said first end wall thereof, said first and third side walls of said second nose being opposite, said second and fourth side walls of said second nose being opposite, contact support means formed in said second nose for mounting electrically conductive contacts within said second nose, at least one laterally extending projection and nose notch integrally formed adjacent each other on each of said first and third side walls of said second nose;

said nose notches on said third side wall of said first nose and on said first side wall of said second nose receiving said projections on said first side wall of said second nose and on said third side wall of said first nose, respectively.

2. An electrical connector according to claim 1 wherein said projections and nose notches are tapered in a lateral direction.

3. An electrical connector according to claim 1 wherein said projections and nose notches are tapered in a lateral outward direction.

4. An electrical connector according to claim 1 wherein, for each of said first and second noses, said projection and said nose notch on said first side wall are laterally offset from said projection and said nose notch on said third side wall, respectively;

said projection on said first side wall is aligned with said nose notch on said third side wall; and said projection on said third side wall is aligned with said nose notch on said first side wall.

5. An electrical connector according to claim 1 wherein each of said noses comprises attachment means on said second and fourth side walls for securing said nose to said housing.

6. An electrical connector, comprising:

a first nose of dielectric material having first, second, third and fourth side walls and first and second opposite end walls, said side walls defining a plug receiving cavity opening through at least said first end wall, said first and third side walls being opposite, said second and fourth side walls being opposite;

contact support means, formed in said nose, for mounting electrically conductive contacts within said nose;

at least one laterally extending projection tapered in a lateral direction and integrally formed on each of said first and third side walls of said nose;

at least one nose notch tapered in a lateral direction on each of said first and third side walls adjacent to said projection thereon, said projections and said nose notches having complementary configurations; and a housing having a recess opening on at least one surface of said housing and receiving said nose, and having housing notches mating with and receiving said projections, said housing notches opening into said recess.

7. An electrical connector according to claim 6 wherein said projections and nose notches are tapered in a lateral outward direction.

8. An electrical connector according to claim 6 wherein said nose comprises two of said projections on each of said first and third side walls.

9. An electrical connector according to claim 8 wherein said nose comprises two nose notches on each said first and third side walls adjacent said projections thereon, said projections and said nose notches having complementary configurations.

10. An electrical connector according to claim 9 wherein said projections and said nose notches on said first side wall are laterally offset from said projections and said nose notches on said third side wall, respectively;

each of said projections on said first side wall is aligned with one of said nose notches on said third side wall; and each of said projections on said third side wall is aligned with one on said nose notches on said first side wall.

11. An electrical connector according to claim 10 wherein said projections and said nose notches are generally coplanar with one of said end walls.

12. An electrical connector, comprising:

a first nose of dielectric material having first, second, third and fourth side walls and first and second opposite end walls, said side walls defining a plug receiving cavity opening through at least said first end wall, said first and third side walls being opposite, said second and fourth side walls being opposite;

contact support means, formed in said nose, for mounting electrically conductive contacts within said nose;

at least one laterally extending projection integrally formed on each of said first and third side walls of said nose;

a housing having a recess opening on at least one surface of said housing and receiving said nose, and having housing notches mating with and receiving said projections, said housing notches opening into said recess; and attachment means on said second and fourth side walls for securing said nose to said housing.

13. An electrical connector according to claim 12 wherein said nose comprises at least one nose notch on each of said first and third side walls adjacent to said projection thereon, said projections and said nose notches having complementary configurations.

14. An electrical connector according to claim 13 wherein said projection and said nose notch on said first side wall are laterally offset from said projection and said nose notch on said third side wall, respectively; and said projection on said first side wall is aligned with said nose notch on said third side wall; and said projection on said third side wall is aligned with said nose notch on said first side wall.

15. An electrical connector according to claim 14 wherein said projections and said nose notches are generally coplanar with one of said end walls.

16. An electrical connector comprising:

first and second noses of dielectric material, each of said noses, including first, second, third and fourth side walls defining a plug receiving cavity, said first and third side walls being opposite, said second and fourth side walls being opposite, first and second opposite end walls, said cavity opening on said first end wall, contact support means formed on said side walls for mounting electrically conductive contacts with said cavity, at least one laterally extending projection integrally formed on each of said first and third side walls, and at least one nose notch on each of said first and third side walls adjacent to said projection thereon, said projections and said nose notches having complementary configurations, said projection and said nose notch on said first side wall being laterally offset from said projection and said nose notch on said third side wall, respectively; and said projection on said first side wall being aligned with said nose notch on said third side wall; and said projection on said third side wall being aligned with said nose notch on said first side wall; and said first and second noses being engaged with said third side wall of said first nose abutting said first side wall of said second nose, and with said nose notches on said third side wall of said first nose and on said first side wall of said second nose receiving said projections on said first side wall of said second nose and on said third side wall of said first nose, respectively.

17. An electrical connector according to claim 16 wherein said projections and said nose notches are generally coplanar with one of said end walls.

18. An electrical connector according to claim 16 wherein each of said noses comprises two of said projections and two of said nose notches on each of said first and third side walls thereof.

19. An electrical connector according to claim 16 wherein said first and second noses are mounted in a housing.

20. An electrical connector according to claim 19 wherein said housing comprises housing notches receiving said projections on said first side wall of said first nose and said third side wall of said second nose.

21. An electrical connector, comprising:

a first nose of dielectric material having first, second, third and fourth side walls and first and second opposite end walls, said side walls defining a plug receiving cavity opening through at least said first end wall, said first and third side walls being opposite, said second and fourth side walls being opposite;

contact support means, formed in said nose, for mounting electrically conductive contacts within said nose;

at least one laterally extending projection integrally formed and fixedly mounted on each of said first and third side walls of said nose;

at least one nose notch on each of said first and third side walls adjacent to said projection thereon, said projections and said nose notches having complementary configurations, said projection and said nose notch on said first side wall being laterally offset from said projection and said nose notch on said third side wall, respectively, said projection on said first side wall being aligned with said nose notch on said third side wall, said projection on said third side wall being aligned with said nose notch on said first side wall; and a housing having a recess opening on at least one surface of said housing and receiving said nose, and having housing notches mating with and receiving said projections, said housing notches opening into said recess.

* * * * *